US006637971B1

(12) United States Patent
Carney, III et al.

(10) Patent No.: US 6,637,971 B1
(45) Date of Patent: Oct. 28, 2003

(54) REUSABLE HIGH MOLECULAR WEIGHT/ HIGH DENSITY POLYETHYLENE GUARDRAIL

(75) Inventors: John F. Carney, III, Worcester, MA (US); Malcolm H. Ray, Canton, ME (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 10/000,620

(22) Filed: Nov. 1, 2001

(51) Int. Cl.[7] ..... E01F 15/00
(52) U.S. Cl. ..... 404/6; 404/10; 256/13.1
(58) Field of Search ..... 404/6, 10; 256/13.1, 256/23

(56) References Cited

U.S. PATENT DOCUMENTS

| | | | | | |
|---|---|---|---|---|---|
| 368,459 | A | * | 8/1887 | Clow | 256/45 |
| 1,839,015 | A | | 12/1931 | Deveaux | 454/363 |
| 1,970,737 | A | * | 8/1934 | Cole | 248/66 |
| 1,974,232 | A | * | 9/1934 | Brown | 256/13.1 |
| 1,977,286 | A | * | 10/1934 | Miller | 256/13.1 |
| 2,167,635 | A | * | 8/1939 | Camp | 256/13.1 |
| 2,193,689 | A | * | 3/1940 | Gleason et al. | 248/66 |
| 2,204,557 | A | * | 6/1940 | Ahles | 256/13.1 |
| 2,238,523 | A | * | 4/1941 | Holst | 256/13.1 |
| 2,677,530 | A | * | 5/1954 | Lauffenburger | 256/13.1 |
| 3,450,405 | A | * | 6/1969 | Mates | 473/492 |
| 3,845,936 | A | | 11/1974 | Boedecker | 256/1 |
| 4,146,113 | A | | 3/1979 | Gavel | 181/210 |
| 4,190,275 | A | | 2/1980 | Mileti | 293/102 |
| 4,200,310 | A | | 4/1980 | Carney, III | 280/784 |
| 4,553,739 | A | * | 11/1985 | Baines | 256/23 |
| 4,558,851 | A | * | 12/1985 | Nakayama | 256/24 |
| 4,583,716 | A | | 4/1986 | Stephens et al. | 256/13 |
| 4,600,178 | A | | 7/1986 | Zucker et al. | 256/1 |
| 4,645,375 | A | | 2/1987 | Carney, III | 404/6 |
| 4,658,941 | A | | 4/1987 | Gottwald et al. | 188/377 |

(List continued on next page.)

FOREIGN PATENT DOCUMENTS

| | | | |
|---|---|---|---|
| DE | 2251749 | 1/1992 | 404/352 |
| GB | 363658 | 1/1931 | 293/136 |

OTHER PUBLICATIONS

Energy Dissipation in High Molecular Weight High Density Polyethylene By Pragan Buha Thesis Submitted to the Faculty of the Graduate School of Vanderbilt University in partial fulfillment of the requirements for the degree of Master of Science in Civil Engineering May 1990 Nashville, Tennessee.

(List continued on next page.)

*Primary Examiner*—Gary S. Hartmann
(74) *Attorney, Agent, or Firm*—Waddey & Patterson; I. C. Waddey, Jr.

(57) ABSTRACT

The present invention provides a reusable high molecular weight, high density polyethylene guardrail designed for economical construction and rapid replacement of the elements comprising the guardrail system. This guardrail system is energy absorbing and comprises a plurality of stanchions, a plurality of connector sleeves, a horizontal barrier engaging the connector sleeves, and a plurality of location devices containing a contact surface used to support the connector sleeves. In the guardrail system, the stanchions engage the ground while the connector sleeves encompass a portion of the stanchion protruding from the ground. The horizontal barrier traverses consecutive connector sleeves by passing through from the exterior to the interior and back to the exterior of a connector sleeve. The location devices support the connector sleeves, which in turn locate the horizontal barrier, on stanchions at the proper height to engage vehicles alighting from the driving surface, yet enable, the sleeve to move up along the stanchion upon impact of a vehicle with the barrier.

28 Claims, 4 Drawing Sheets

U.S. PATENT DOCUMENTS

| | | | | | |
|---|---|---|---|---|---|
| 4,711,481 | A | | 12/1987 | Krage et al. | 293/133 |
| 4,787,602 | A | * | 11/1988 | Pidgeon | 256/23 |
| 4,797,026 | A | | 1/1989 | Webster | 404/28 |
| 4,944,493 | A | * | 7/1990 | Handy | 256/23 |
| 5,011,326 | A | | 4/1991 | Carney, III | 404/6 |
| 5,031,947 | A | | 7/1991 | Chen | 293/135 |
| 5,052,732 | A | | 10/1991 | Oplet et al. | 293/102 |
| 5,120,154 | A | | 6/1992 | Lasch et al. | 404/14 |
| 5,125,762 | A | | 6/1992 | Strassil | 404/6 |
| 5,131,630 | A | * | 7/1992 | Nash | 256/12.5 |
| 5,199,755 | A | | 4/1993 | Gertz | 293/120 |
| 5,234,280 | A | | 8/1993 | Cowan | 404/6 |
| 5,261,647 | A | * | 11/1993 | Venegas et al. | 256/13.1 |
| 5,314,261 | A | | 5/1994 | Stephens | 404/6 |
| 5,316,815 | A | | 5/1994 | Tripp | 428/65 |
| 5,403,112 | A | | 4/1995 | Carney, III | 404/6 |
| 5,507,473 | A | * | 4/1996 | Hammer et al. | 256/13.1 |
| 6,010,275 | A | | 1/2000 | Fitch | 404/6 |
| 6,082,926 | A | | 7/2000 | Zimmer | 404/6 |
| 6,131,886 | A | * | 10/2000 | Venegas, Jr. | 256/59 |
| 6,276,667 | B1 | * | 8/2001 | Arthur | 256/13.1 |

OTHER PUBLICATIONS

Energy Dissipation of High Molecular Weight/High Density Polyethylene Tubes By Mary Margaret McNeese Theisis Submitted to the Faculty of the Graduate School of Vanderbilt University in partial fulfillment of the requirements for the degree of Master of Science in Civil Engineering May 1992 Nashville, Tennessee.

* cited by examiner

REUSABLE HIGH MOLECULAR WEIGHT/ HIGH DENSITY POLYETHYLENE GUARDRAIL

BACKGROUND OF THE INVENTION

1. Field of the Invention

The present invention relates generally to a reusable, energy absorbing, high molecular weight, high density polyethylene guardrail system designed to retain vehicles on or near a roadway, thereby lessening damage to the vehicles and decreasing the likelihood of serious injury to the occupants of the vehicles during vehicular accidents.

2. Description of the Prior Art

Automobile safety devices are not uncommon on the roadways. Most of these devices are restraint systems, placed along the edges of the highways, freeways and interstates, designed to contain the vehicles to the driving surface. Restrainment is crucial in reducing injury to the occupants of the vehicles and damage to the vehicles themselves by protecting such vehicles from both striking other objects, such as rock formations and other vehicles, and plummeting over roadside cliffs.

The standard roadside restrainment device comprises wood or metal rails firmly affixed to wood or metal post, which are implanted in the ground. These standard restraint devices, while designed to maintain vehicles involved in accidents on the roadway, can actually vault vehicles over the restraining devices and increase the danger to a vehicle and its inhabitants.

This increased danger occurs when the posts of the standard restraint device are deflected during an accident. As a vehicle impacts with the standard restraint device, the energy of the impact forces the post of the standard restraint device backwards. Since the post is implanted in the ground, the top portion of the post bends away from the impact and vertically down. This deflection pulls the affixed metal rails downward and creates a ramp type structure, thereby vaulting the vehicle over the standard restraint device. In essence, the purpose of most standard restraint devices is thwarted by the actual design of the standard restraint devices.

Some restraining devices correctly accomplish the restraint objective. However, most of these devices require complicated initial construction or a complete replacement of the restraint device once an impact between a vehicle and a restraint device occurs.

For example, Stevens U.S. Pat. No. 5,314,261, assigned to Energy Absorption Systems, Inc., requires complicated mechanical linkages and numerous bolts and couplings in order to assemble the restraint device. Also, each element of the Stevens "Vehicular Crash Cushion" mandates multiple fasteners in order to secure the restraint system. To exacerbate the situation, several key impact elements of this device could be damaged after each substantial collision and must then be replaced before the device will function correctly. This leads to enormous expenditures of time and money in each instance the Stevens device requires assembly or replacement.

Fitch U.S. Pat. No. 6,010,275 also requires numerous mechanical attachments in order to create a vehicular restraint device. The Fitch "Compression Guardrail" uses multiple constriction bands, or other fasteners, to secure the restraint system. After an impact in which any single element of the device is damaged, the entire system must be disassembled. Then the entire system must be reconstructed in order to return the restraint device to its operational condition.

Thus, there is a need in the art for a reusable high molecular weight, high density polyethylene automobile restraint device with the capability of rapid and economical replacement of the components of the restraint device.

SUMMARY OF THE INVENTION

The present invention provides a reusable high molecular weight, high density polyethylene guardrail designed for economical construction and rapid replacement of the elements comprising the guardrail system. This guardrail system comprises a plurality of energy absorbing stanchions, a plurality of energy absorbing connector sleeves, a plurality of energy absorbing horizontal barriers engaging the energy absorbing connector sleeves, and a plurality of location devices containing a contact surface used to support the energy absorbing connector sleeves.

In the guardrail system, the energy absorbing stanchions engage the ground while the energy absorbing connector sleeves encompass a portion of the stanchion protruding from the ground. The energy absorbing horizontal barriers traverse consecutive connector sleeves by passing through from the exterior to the interior and back to the exterior of a connector sleeve. The location devices support the connector sleeves, which in turn locate the horizontal barriers, on stanchions at the proper height to engage vehicles alighting from the driving surface.

The elements of the present guardrail system are specifically designed and assembled to maintain a vehicle on the roadway surface once an impact has occurred between the guardrail system and the vehicle. Namely, the interaction between the stanchions, the connector sleeves and the location devices facilitate the containment of the vehicles to the roadway by maintaining the connector sleeves at the proper engagement height throughout an impact between the guardrail system and a vehicle. This substantially decreases the likelihood of a vehicle overturning, flipping end over end, or vaulting over the guardrail system once an impact between a vehicle and the guardrail system occurs.

To increase the continued effectiveness of the guardrail system, the energy absorbing connector sleeves are designed to easily lift off the location devices and slide over the energy absorbing stanchions. This action removes the connector sleeves and the energy absorbing horizontal barriers from the guardrail system and facilitates replacement of the connector sleeves and horizontal barriers. This novel design allows for rapid and economical replacement of the damaged elements of the guardrail system once an impact has damaged the system.

In fact, if just the horizontal barriers are damaged, the design of this invention allows for the uncomplicated replacement of only the horizontal barriers. This activity is accomplished by simply sliding the energy absorbing horizontal barriers out of the energy absorbing connector sleeves and replacing the energy absorbing horizontal barriers without removing the energy absorbing connector sleeves from the energy absorbing stanchions.

It is therefore a general object of the present invention to provide a guardrail system to contain vehicles on or near the roadway.

Another object of the present invention is to provide a guardrail system to absorb the energy of vehicles disembarking the roadway.

Another object of the present invention is to provide a guardrail system to substantially decrease the likelihood of a vehicle overturning, flipping end over end, or vaulting over the guardrail system once an impact between a vehicle and the guardrail system occurs.

Yet another object of the present invention is to provide a guardrail system composed of high molecular weight, high density polyethylene material.

Still another object of the invention is to provide a guardrail system which is reusable after an impact between a vehicle and the guardrail system.

Still yet another object of the present invention is to provide a guardrail system that is easily assembled and is an economical alternative to the current vehicle restraint systems.

Numerous other objects, features and advantages of the present invention will be readily apparent to those skilled in the art, upon reading of the following disclosure, when taken in conjunction with the accompanying drawings.

DETAILED DESCRIPTION OF THE PREFERRED EMBODIMENTS

Figure 1:
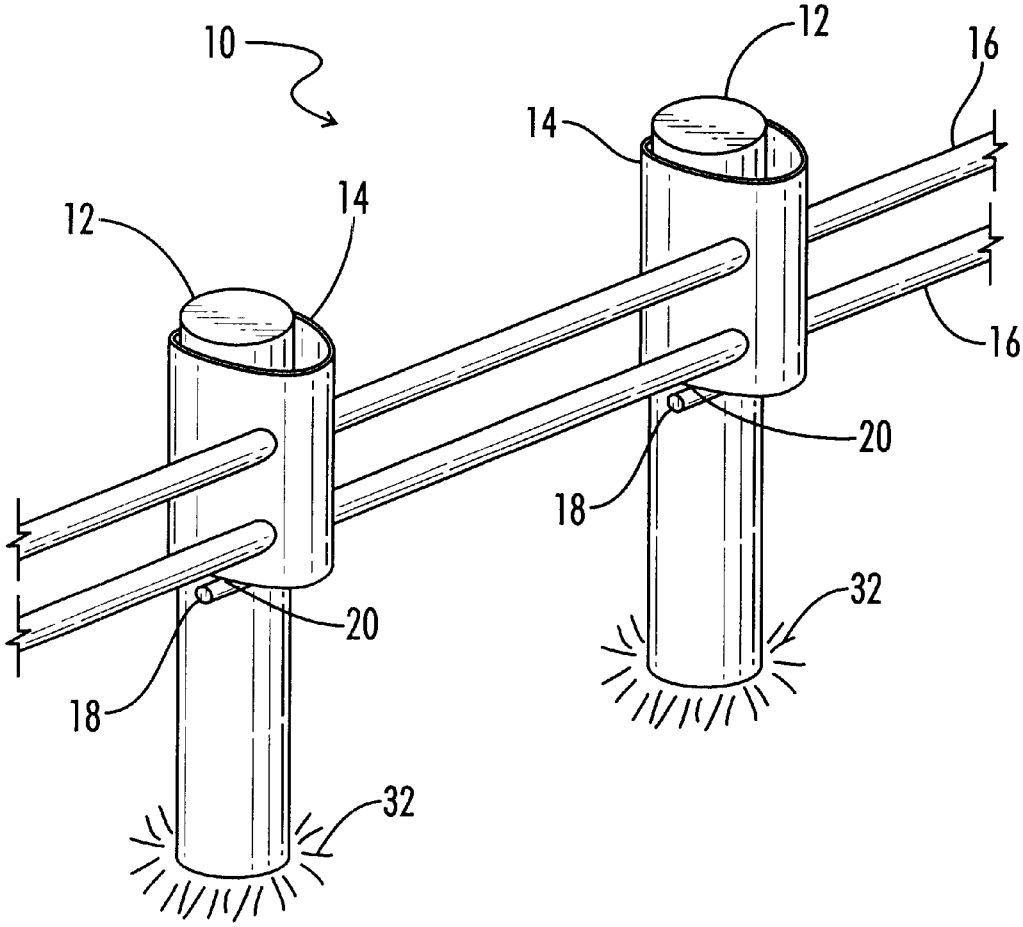
FIG. 1 is a perspective view of the guardrail system.

Referring now to FIG. 1, the guardrail system of the present invention is shown and generally designated by the numeral 10. The guardrail system 10 is a safety restraint system for retaining vehicles on the roadway using materials and designs to decelerate and redirect such vehicles. The guardrail system 10 comprises a plurality of energy absorbing stanchions 12, a plurality of energy absorbing connector sleeves 14, a plurality of energy absorbing horizontal barriers 16 and a plurality of location devices 18. The connector sleeves 14 encompass the stanchions 12. The horizontal barriers 16 engage the connector sleeves 14. Finally, the location devices 18 have at least one contact surface 20 with a portion of a connector sleeve 14 sitting on a contact surface 20.

The function of the location devices 18 is to provide support for the connector sleeves 14 and maintain the connector sleeves 14 and the horizontal barriers 16 engaging the connector sleeves 14 at the proper impact height to engage vehicles leaving the driving surface.

The connector sleeves 14 sit on the location devices 18, as opposed to being permanently attached to the stanchions 12. Since the connector sleeves 14 are not rigidly connected to the stanchions 12, the current design allows the connector sleeves 14 and the attached horizontal barriers 16 to slide along the length, and even off, the stanchions 12 as an impact forces the stanchions 12 to deform and change in vertical height.

The current design is an improvement over contemporary retaining devices. The contemporary retaining devices usually have horizontal rails which permanently attach to vertical supports. As the vertical supports deform during impact and decrease in height, the vertical supports pull the horizontal rails downward. This creates a ramp which either catapults the vehicle over the contemporary retaining device, or, in the worst case scenario, causes the vehicle to flip end over end. Since, in the present invention, the connector sleeves 14 and the horizontal barriers 16 freely slide along and off the stanchions 12, the connector sleeves 14 and the horizontal barriers 16 do not force a vehicle impacting with the guardrail system 10 up and over the guardrail system 10.

Figure 6:
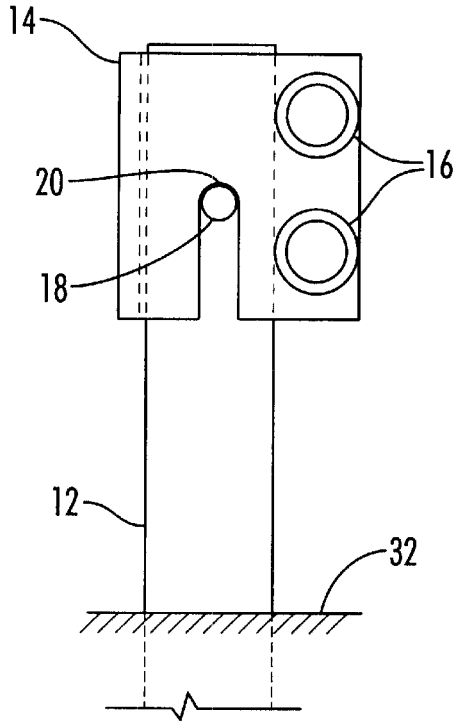
FIG. 6 is a side elevation view of an alternate embodiment of the guardrail system showing a pin as the location device. In the figure, the energy absorbing connector sleeve has a notch used to stabilize the energy absorbing connector sleeve on the location device.
Figure 7:
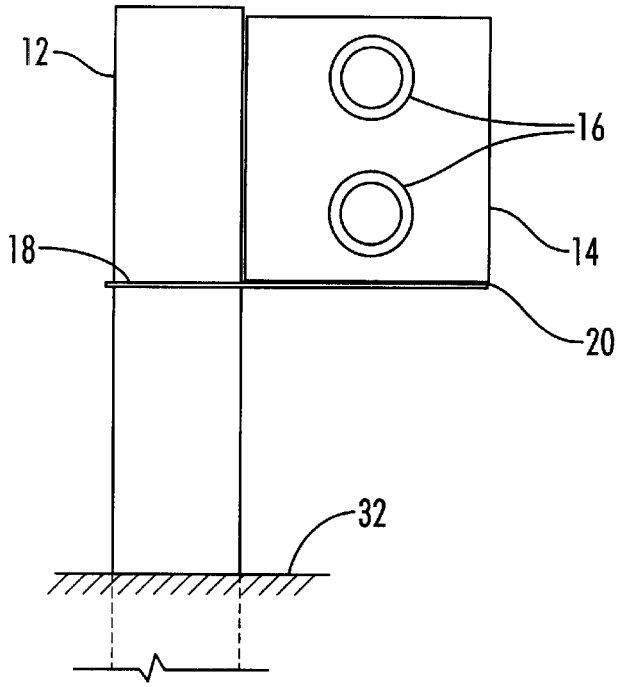
FIG. 7 is a side elevation view of an alternate embodiment of the guardrail system showing an annulus as the location device.
Figure 8:
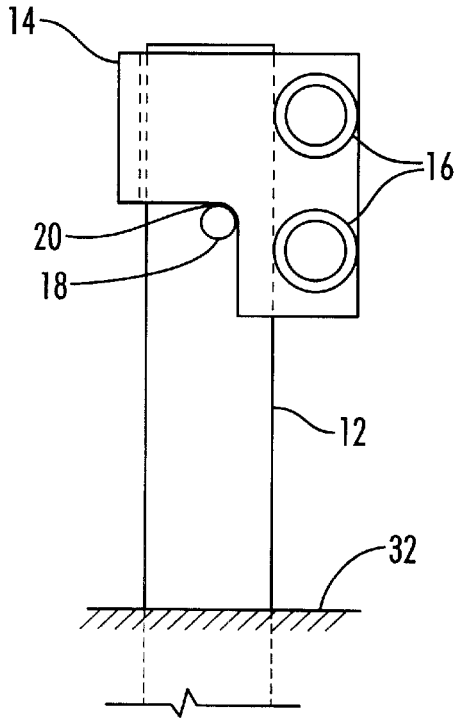
FIG. 8 is a side elevation view of an alternate embodiment of the guardrail system showing the energy absorbing connector sleeve reconfigured to increase the contact area engaging the location device.

As seen in FIGS. 6, 7, and 8, several other embodiments of the engagement between the location devices 18 and the connector sleeves 14 are possible. For example, FIGS. 6 and 8 show adjustments made to the connector sleeves 14 that still allow the connector sleeves 14 to freely disengage the location devices 18 during an impact. Also, FIG. 7 shows an alternate embodiment of the location device 18 that still allows connector sleeves 14 to retain a constant impact height during impact.

Figure 2:
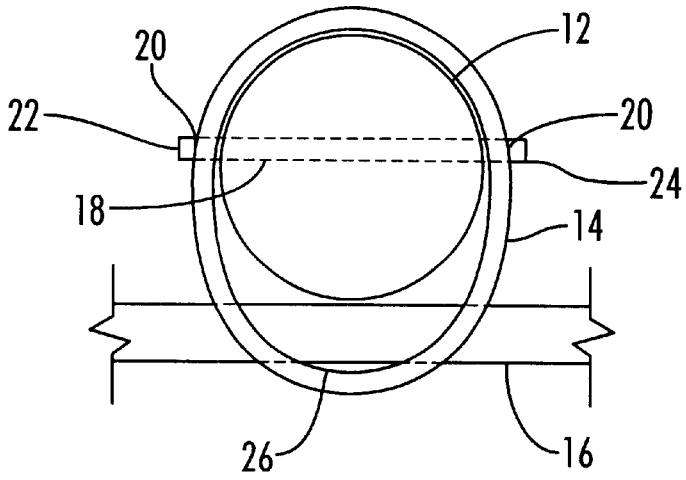
FIG. 2 is a cross-sectional top view of the guardrail system with an energy absorbing stanchion.
Figure 3:
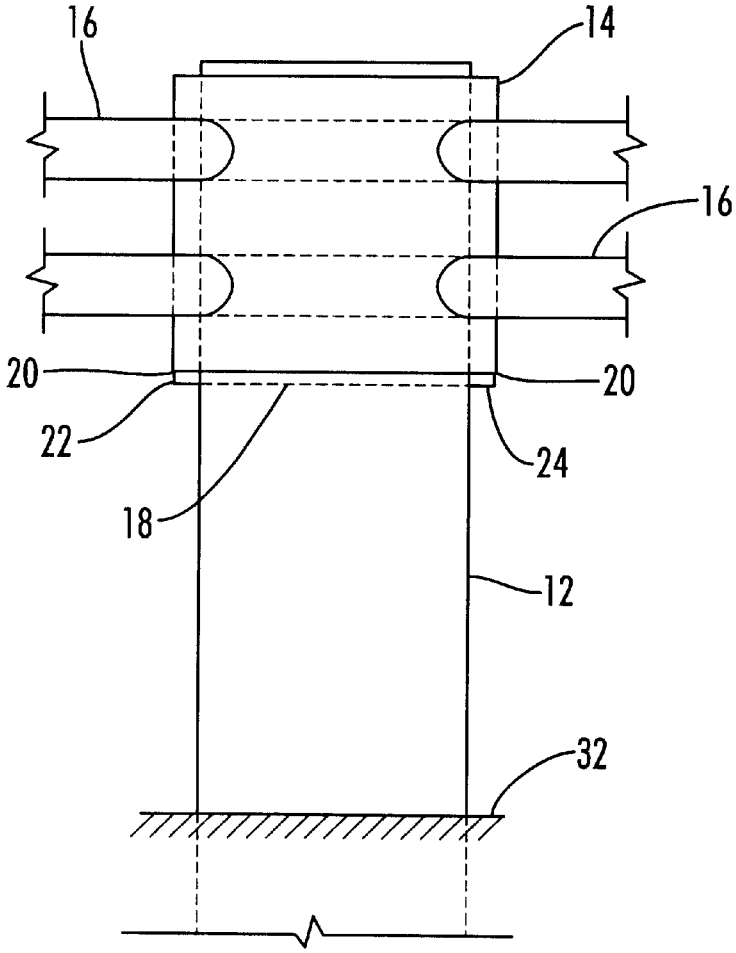
FIG. 3 is a front elevation view of the guardrail system showing the energy absorbing stanchion engaging the ground.
Figure 4:
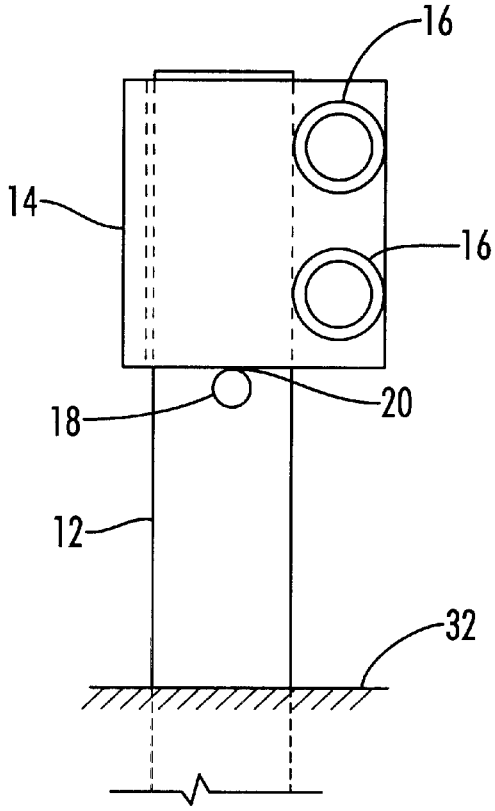
FIG. 4 is a side elevation view of the guardrail system showing a pin as the location device and showing the energy absorbing stanchion engaging the ground.

As shown in FIGS. 2 and 3, in the preferred embodiment of the invention the location device 18 is a standard pin with a distal end 22 and a proximal end 24. The location device 18 traverses the stanchion 12 so that the distal end 22 and the proximal end 24 both protrude from the stanchion 12 and contact and connector sleeve 14. The contact surfaces 20 of the location device 18 support the connector sleeve 14 on the stanchion 12. As seen in FIG. 7, the location device 18 can also be an annulus or numerous other devices known in the art to provide vertical support, including but not limited to clamps, bolts, latches, springs and other similar attachment devices.

Also, in the preferred embodiment the horizontal barriers 16 traverse the connector sleeves 14 and engage the stanchions 12 as seen in FIG. 2. The horizontal barriers 16 traverse consecutive connector sleeves 14 by passing through from the exterior to the interior and back to the exterior of a connector sleeve 14. In alternate embodiments of this invention, the horizontal barriers 16 can engage, or attach to, the exterior surface of the connector sleeve 14 without passing through said connector sleeve 14. Examples of attachments possible in alternate embodiments include bolts, clamps, latches, snap-in recessed cavities, or other industry standard fasteners.

The guardrail system 10 is shown with two cylindrical rails used as horizontal barriers 16. However, standard "W" shaped rails or numerous other designs of horizontal barriers 16 are easily substituted.

In the preferred embodiment, the connector sleeves 14 are cylinders composed of high molecular weight high density polyethylene. As seen in FIGS. 1 and 2, these cylinders have a circumference 26 which encompasses a stanchion 12, such that a stanchion 12 is located within a connector sleeve 14. The connector sleeve 14 encompasses the end of the stanchion 12 distal from the engagement between the stanchion 12 and the ground 32. The placement of the stanchions 12 inside the connector sleeves 14 allows the connector sleeves 14 to dissipate most of the energy from the vehicular impact and protect the stanchions 12 from the collision.

The fact that the stanchions 12 engage the ground 32 provides support for the guardrail system 10. However, in alternative embodiments the stanchions 12 can also be supported by other means including, but not limited to, walls, drums, bases and platforms.

The energy absorbing stanchions 12, energy absorbing connector sleeves 14 and energy absorbing horizontal barriers 16 are composed of high molecular weight, high density polyethylene. The use of this material stems from the need for a vehicle restraint system to include energy absorbing or dampening characteristics. Modern safety standards compel a restraint system to contain these absorbing or dampening characteristics in order to decelerate vehicles as the vehicles disembark from the roadside. This energy absorption, and accompanying deceleration, provides vital milliseconds during a vehicular accident which dramatically increase the chances of survival for the occupants of the vehicle.

Also, the use of high molecular weight high density polyethylene allows the energy absorbing stanchions 12, energy absorbing connector sleeves 14 and the energy absorbing horizontal barriers 16 to return quickly back to their original shape once an impact between a vehicle and the guardrail system 10 has occurred. This helps to maintain the energy absorbing stanchions 12, energy absorbing connector sleeves 14 and the energy absorbing horizontal barriers 16 in their pre-impact positions.

Since the location devices 18 are attached to the stanchions 12, the connector sleeves 14 and the horizontal barrier 16 can be easily removed and replaced if damaged beyond repair. This process is accomplished economically and efficiently by simply lifting the connector sleeves 14 and accompanying horizontal barriers 16 that traverse the connector sleeves 14 off the stanchions 12.

Since the guardrail system 10 lacks complicated mechanical linkages and attachments, this replacement is accomplished in a fraction of the time required for other conventional vehicular restraint devices. Also, all elements of the guardrail system 10, except the stanchions 12, can be repaired or installed without the use of tools. The only tools needed for the stanchions 12 are the tools required to place the stanchions 12 into the ground 32.

The design of the guardrail system 10 also allows for independent replacement of the individual parts of the guardrail system 10. The stanchions 12, connector sleeves 14, the horizontal barriers 16 and location devices 18 are all independently replaceable. In fact, if the horizontal barriers 16 are damaged beyond repair and yet the connector sleeves 14 are still operational, then the horizontal barriers 16 can be removed from the system and new horizontal barriers 16 can be introduced as replacements without removing the connector sleeves 14 from the guardrail system.

Figure 5:
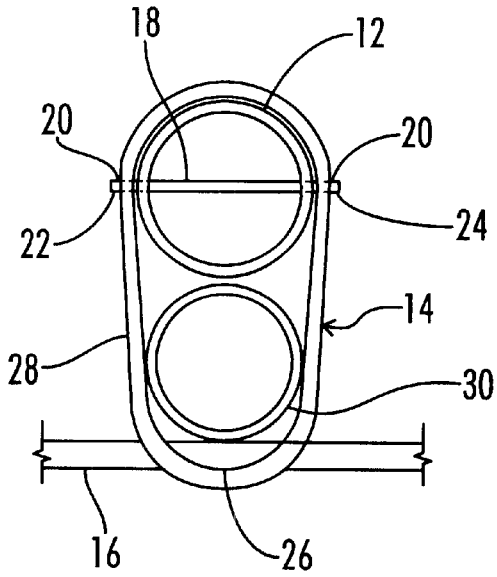
FIG. 5 is a top view of a guardrail system with a hollow energy absorbing stanchion. This figure includes an energy absorbing spacer engaging the energy absorbing connector sleeve, the energy absorbing stanchion and the energy absorbing horizontal barrier.

Looking now to FIG. 5, in an alternate embodiment the connector sleeve 14 includes a first cylinder 28 encompassing a stanchion 12 and an energy absorbing spacer 30. In the preferred embodiment, the energy absorbing spacer 30 is a second cylinder mounted between the first cylinder 28 and the energy absorbing stanchion 12. The energy absorbing spacers 30, composed of high molecular weight, high density polyethylene, engage the horizontal barriers 16, the first cylinders 28 and the stanchions 12. It should be readily apparent that the energy absorbing spacers 30 are not limited to either cylindrical shape or to polyethylene material. For example, the energy absorbing spacers 30 could be in the shape of numerous polygons and be composed of polystyrene, plastic or other energy absorbing material.

In still another embodiment, the energy absorbing spacers 30 only engage the stanchions 12 and the horizontal barriers 16. This embodiment has the energy absorbing spacers 30 attached directly to the stanchions 12 through standard industry fixtures. Also it should be readily apparent, if the horizontal barriers 16 are attached to the exterior of the first cylinder 28, the energy absorbing spacers engage the first cylinder 28 and the stanchions 12 only.

The addition of the energy absorbing spacer 30 provides additional energy dissipation components to the guardrail system. These additional dissipation components can provide the necessary milliseconds to significantly increase the chance of survival to occupants of vehicle accidents at especially dangerous areas along the roadside.

Thus, it is seen that the system of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. An impact diminishing guardrail system, the system comprising:
   - a plurality of stanchions;
   - a plurality of connector sleeves;
   - a horizontal barrier, the barrier engaging the connector sleeves; and
   - a plurality of location devices, at least one of said plurality of location devices connected to one of said plurality of stanchions and limiting the movement of one of said plurality of connector sleeves in one direction while permitting movement in an opposite direction.

2. The guardrail system of claim 1, wherein:
   - a) the contact surface of each of said plurality of location devices having a distal end and a proximal end; and
   - b) one of said plurality of location devices traverses one of said plurality of stanchions, so that said distal end and said proximal end both protrude from said one of said plurality of stanchions and contacts one of said plurality the connector sleeves.

3. The guardrail system of claim 1, wherein said location devices are pins, the pins traversing the stanchions and suspending the connector sleeves.

4. The guardrail system of claim 1, wherein at least one of said location devices is an annulus, said annulus encompassing one of said plurality of stanchions and suspending one of said plurality of connector sleeves.

5. The guardrail system of claim 1, wherein the horizontal barrier traverses at least two of said plurality of connector sleeves and said barrier engages at least two of said plurality of stanchions.

6. The guardrail system of claim 1, wherein at least one of said plurality of connector sleeves is a cylinder, the cylinder having a circumference and one of said plurality of stanchions is located within said circumference.

7. The guardrail system of claim 1, wherein at least one of said plurality of connector sleeves is composed of high molecular weight, high density polyethylene.

8. The guardrail system of claim 1, wherein at least one of said stanchions is composed of high molecular weight, high density polyethylene.

9. The guardrail system of claim 1, wherein the horizontal barrier is composed of high molecular weight, high density polyethylene.

10. The guardrail system of claim 1, wherein:

a) at least one of said plurality of connector sleeves comprises a first cylinder and a second cylinder, the first cylinder and second cylinder composed of high molecular weight, high density polyethylene;

b) the first cylinder encompasses the stanchion;

c) the second cylinder mounts between the first cylinder and the stanchion; and d) the second cylinder engages both the horizontal barrier and the stanchion.

11. An impact diminishing guardrail system, the guardrail system comprising:

a plurality of stanchions, the stanchions engaging the ground;

a plurality of connector sleeves, the connector sleeves encompassing the stanchions;

a horizontal barrier, the barrier engaging the connector sleeves; and a plurality of location devices, the location devices supporting the connector sleeves on the stanchions for slideable movement relative thereto.

12. The guardrail system of claim 11, wherein the connector sleeves are cylinders, the cylinders having a circumference and one of the plurality of stanchions is located within the circumference.

13. The guardrail system of claim 11, wherein the location device traverses the stanchion and suspends the connector sleeve.

14. The guardrail system of claim 11, wherein the horizontal barrier traverses the connector sleeves and the barrier engages the stanchions.

15. The guardrail system of claim 11, wherein the connector sleeves are composed of high molecular weight, high density polyethylene.

16. The guardrail system of claim 11, wherein the stanchions are composed of high molecular weight, high density polyethylene.

17. The guardrail system of claim 11, wherein the horizontal barrier is composed of high molecular weight, high density polyethylene.

18. The guardrail system of claim 11, wherein:

a) each connector sleeve comprises a first cylinder and a second cylinder, the first cylinder and second cylinder composed of high molecular weight, high density polyethylene;

b) the first cylinder encompasses one of the plurality of stanchions;

c) the second cylinder mounts between the first cylinder and the stanchion; and d) the second cylinder engages both the horizontal barrier and the stanchion.

19. An impact diminishing guardrail system, the guardrail system comprising:

a plurality of stanchions;

a plurality of connector sleeves, the connector sleeves encompassing the stanchions;

a horizontal barrier, the barrier traversing the connector sleeves; and a plurality of location means for supporting the connector sleeves on the stanchions for enabling the connector sleeves to slide off the stanchions upon the impact of an object against said barrier.

20. The guardrail system of claim 19, wherein the horizontal barrier engages the stanchions as the horizontal barrier traverses the connector sleeves.

21. The guardrail system of claim 19, wherein the connector sleeves are cylinders composed of high molecular weight, high density polyethylene.

22. An impact diminishing guardrail system, the guardrail system comprising:

a plurality of stanchions;

a plurality of connector sleeves, one of said plurality of connector sleeves encompassing one of said plurality of stanchions;

a horizontal barrier, the barrier engaging the connector sleeves;

a plurality of spacers, one of the plurality of spacers located within one of said plurality of connector sleeves and each of said spacers engaging one of said plurality of stanchions; and a plurality of location devices, the location devices having a contact surface with at least a portion of one of said connector sleeves sitting on one of said contact surfaces to limit movement of said connector sleeve in one direction and allow movement of said connector sleeve in an opposite direction.

23. The guardrail system of claim 22, wherein one of the spacers engages one of the connector sleeves.

24. The guardrail system of claim 22, wherein the spacers are cylinders composed of high molecular weight, high density polyethylene.

25. The guardrail system of claim 22, wherein the connector sleeves are cylinders composed of high molecular weight, high density polyethylene.

26. The guardrail system of claim 22, wherein the horizontal barrier is composed of high molecular weight, high density polyethylene.

27. The guardrail system of claim 22, wherein the stanchions are composed of high molecular weight, high density polyethylene.

28. The guardrail system of claim 22, wherein the horizontal barrier traverse the connector sleeves and the spacers engage the horizontal barrier.

* * * * *